US008375492B2

(12) United States Patent
Hsu

(10) Patent No.: US 8,375,492 B2
(45) Date of Patent: Feb. 19, 2013

(54) MATTRESS STRUCTURE

(76) Inventor: Han-Chung Hsu, Taipei (TW)

( * ) Notice: Subject to any disclaimer, the term of this patent is extended or adjusted under 35 U.S.C. 154(b) by 115 days.

(21) Appl. No.: 12/939,438

(22) Filed: Nov. 4, 2010

(65) Prior Publication Data

US 2012/0110744 A1 May 10, 2012

(51) Int. Cl.
*A47C 17/00* (2006.01)

(52) U.S. Cl. ..... 5/697; 5/690; 5/716; 5/936; 5/701

(58) Field of Classification Search ..... 5/690, 697, 5/716, 727, 936; 267/170, 177
See application file for complete search history.

(56) References Cited

U.S. PATENT DOCUMENTS 3,252,170 A * 5/1966 Frye ..... 5/697
4,222,137 A * 9/1980 Usami ..... 5/727
6,003,178 A * 12/1999 Montoni ..... 5/690
6,487,738 B1 * 12/2002 Graebe ..... 5/719
7,458,121 B1 * 12/2008 Hsu ..... 5/716
7,934,277 B1 * 5/2011 Shu ..... 5/690
2008/0276377 A1 * 11/2008 Hsu ..... 5/727

OTHER PUBLICATIONS

U.S. Appl. No. 12/877,275, filed Sep. 8, 2010, Han-Chung Hsu.

* cited by examiner

*Primary Examiner* — Robert G Santos
*Assistant Examiner* — Brittany Wilson
(74) *Attorney, Agent, or Firm* — Ming Chow; Sinorica, LLC

(57) ABSTRACT

The mattress structure comprises: a mattress body; a fixing plate, being firmly disposed in the mattress body and having a plurality of fixing holes; a moving plate, being disposed in the mattress body and above the fixing plate, the moving plate having a plurality of penetrating holes; a plurality of flexible members, being disposed on the surface of the top end of the moving plate; a plurality of fixing members, each of the fixing members having a fastening end and a connecting end; and a plurality of lifting devices, being disposed at the bottom of the moving plate, by means of the lifting devices driving the moving plate and the fixing members holding the flexible members, the flexible members being then compressed in order to adjust the flexible supporting forces of the mattress body.

6 Claims, 6 Drawing Sheets

MATTRESS STRUCTURE

BACKGROUND OF THE INVENTION

1. Field of the Invention

The present invention generally relates to a mattress structure, more particularly to a mattress structure that is able to adjust the flexible supporting forces thereof so as to let that different users can be provided with different levels of softness.

2. Description of the Prior Art

Under the leadership of science and technology, the life is always fast and in pressure. At the end of a day, everybody needs a good sleep to completely relax the body for the next day.

Except for work and normal life, 30% time is for sleep for a human being. The quality of a sleep may directly affect the health of the human being. Accordingly, demands to a mattress may then be more than ever. The prior mattresses are mostly made by the way of integration molding, and the softness of a mattress shall be adjusted based on the requirements of a user. It costs a lot as always and is inconvenient. The prior mattress structure has a mattress body and a flexible member in the mattress body, but it is full of disadvantages listed below:

After using a period of time, partial of the flexible member is damaged as a sunken portion so as to affect sleep.

The flexibility of each part of the surface of the prior mattress structure is the same and may not be changed; the flexibility cannot be adjusted according to different users as well, and therefore the ergonomic cannot be met.

Since the flexible member is made by integration molding, a chain reaction can happen. If two people with different sleep habits lie on a bed, one people may be affected by another. Hence, an option for solving the problem is to purchase another mattress structure for more comfortable, but it is definitely not an economic way.

The inventor of the present invention had applied a patent application, titled mattress structure, to USPTO on Sep. 8, 2010, and the application Ser. No. 12/877,275. The patent application adopts two layers of flexible members in order to adjust the hardness of the mattress structure. Frankly speaking, the two layers of flexible members take higher cost of manufacturing and assembling.

The inventor of the present invention has hardly worked on the issue to develop the new mattress structure of the present invention, and it will be discussed as below.

SUMMARY OF THE INVENTION

The main objective of the present invention is to provide a mattress structure, which applies the movement of a moving plate and the connections and fixes of fixing members and flexible members in order to adjust the flexible supporting forces of the mattress structure. Thus different users can be provided with different levels of softness.

To achieve the objective, the present invention provides the mattress structure comprises: a mattress body; a fixing plate, being firmly disposed in the mattress body and having a plurality of fixing holes; a moving plate, being disposed in the mattress body and above the fixing plate, the moving plate having a plurality of penetrating holes; a plurality of flexible members, being disposed on the surface of the top end of the moving plate, the bottom ends of the flexible members being corresponding to the penetrating holes; a plurality of fixing members, each of the fixing members having a fastening end and a connecting end, the fastening end going through the penetrating hole and associating with the fixing hole of the fixing plate, the connecting end joining with the top end of the flexible member; and a plurality of lifting devices, being disposed at the bottom of the moving plate, by means of the lifting devices driving the moving plate and the fixing members holding the flexible members, the flexible members being then compressed in order to adjust the flexible supporting forces of the mattress body.

While the user increases the flexible supporting forces of the mattress structure, to start the motors is to drive the power transmission shafts to move the moving plate upwardly. Meanwhile the flexible members are compressed by the moving plate due to the movement of the moving plate. Since each of the flexible members is firmly connected with the fixing member, then one end of the flexible member is fixed and the other end of the flexible member is compressed. Apparently, the flexible member appears a state of squeeze, and the flexible supporting force is increased. On the contrary, when the user wants to decrease the flexible supporting forces, through the motors of the lifting devices driving the moving plate downwardly is to decrease the squeeze condition of the flexible members, so that the flexible supporting forces are decreased.

Preferably, the fastening end of the fixing member is shaped as a ladder-type structure so as to let the fixing member be fixed in the fixing plate while the fastening end is inserted into the fixing hole; the connecting end is shaped as an L-type structure in order to hook the top end of the flexible member for connecting the fixing member and the flexible member.

Preferably, the lifting devices are disposed at the four corners of the moving plate.

Preferably, the lifting devices are disposed at the center of the moving plate.

Preferably, the power transmission shaft is a screw rod.

Preferably, the top layer of the flexible member is a flexible layer, a wrapper is covered around the peripheries of the mattress body. So that the effect of sleep is raised.

Preferably, the lifting device is connected with a remote receiver and a remote emitter, an operator uses the remote receiver to control the up and down actions of the lifting device by means of the remote emitter transmitting signals to the remote receiver.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
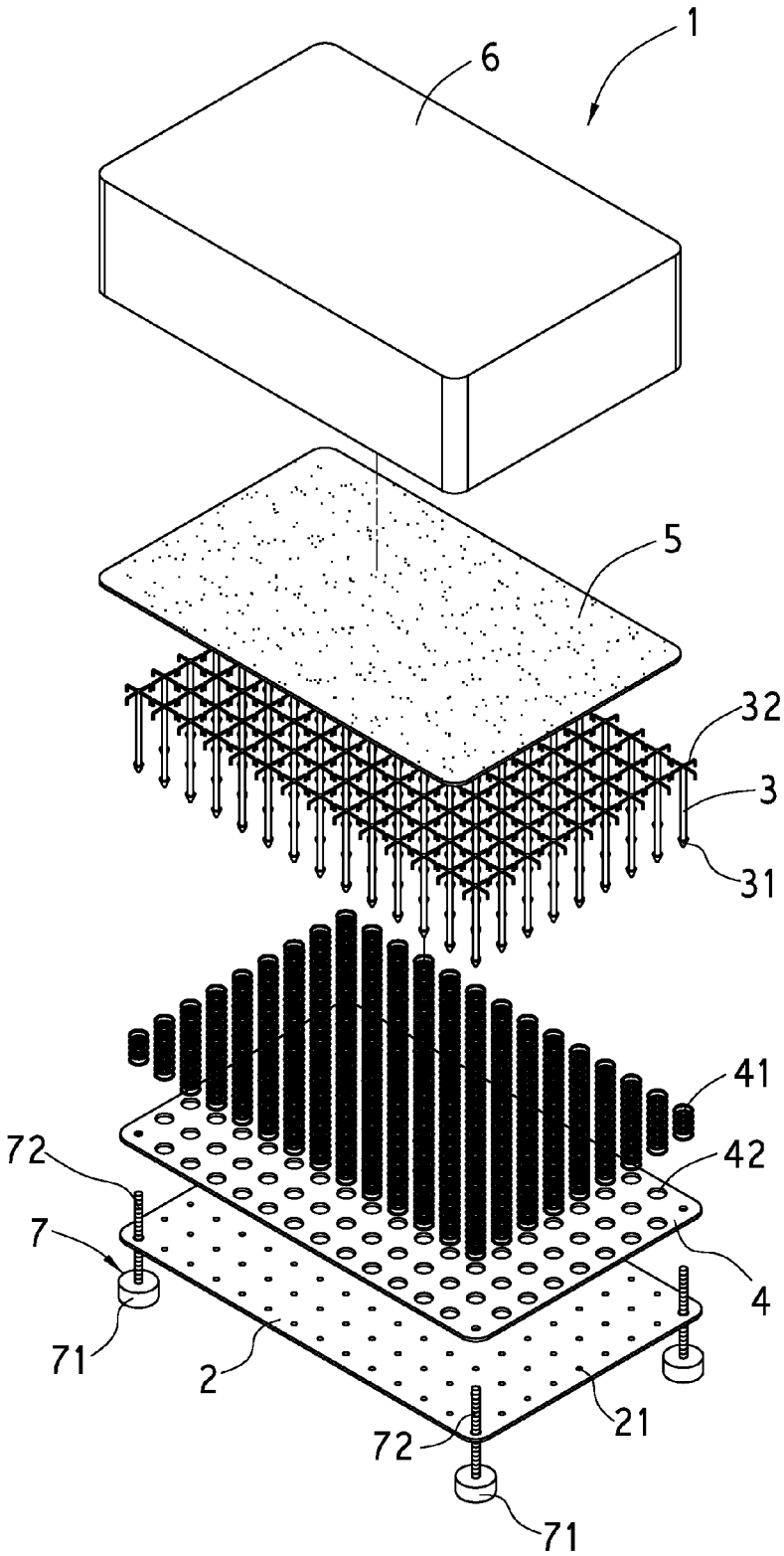
FIG. 1 illustrates a schematic 3-D exploded view of the mattress structure of the present invention.
Figure 2:
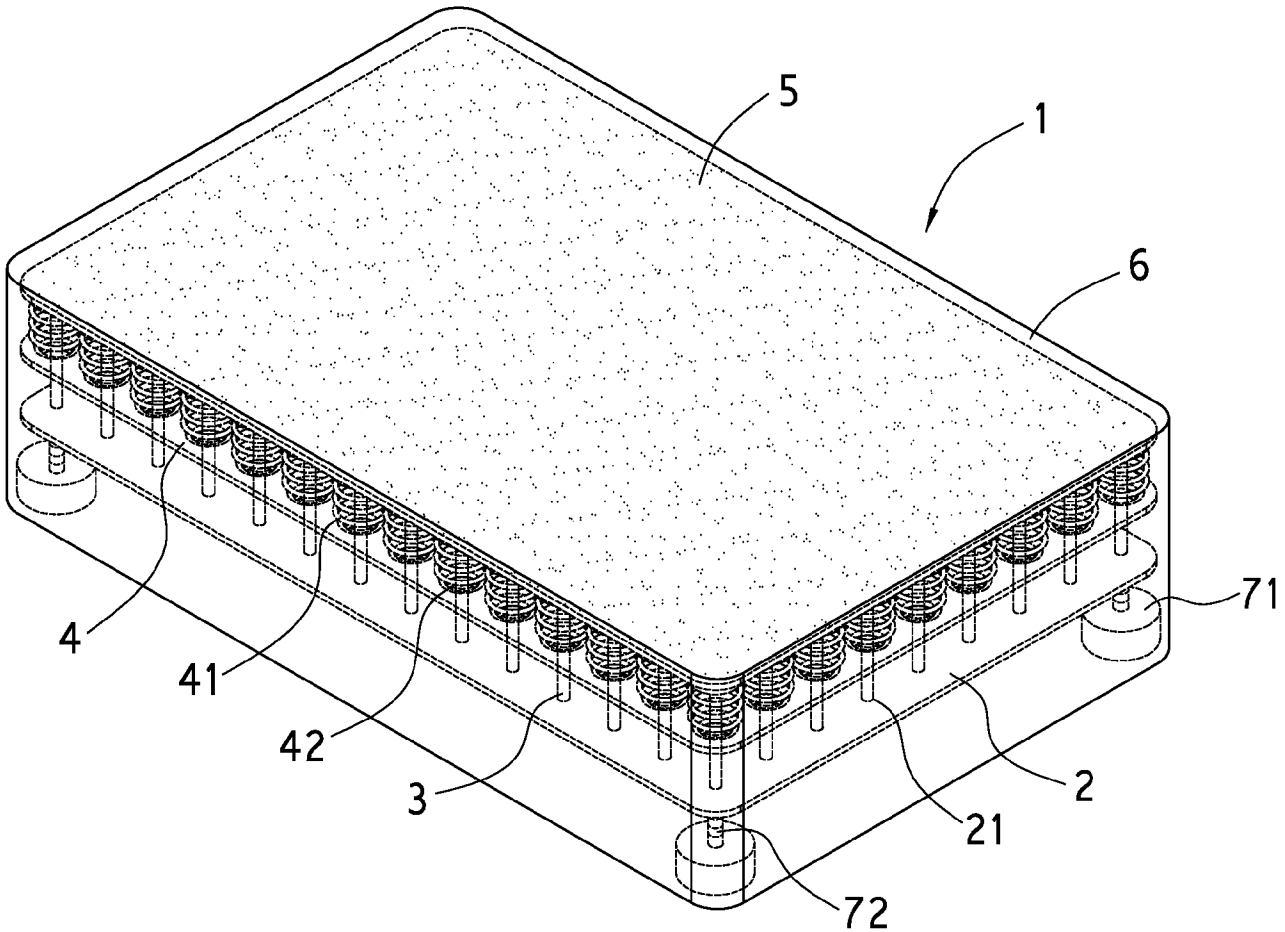
FIG. 2 illustrates a schematic 3-D assembled view of the mattress structure of the present invention.
Figure 3:
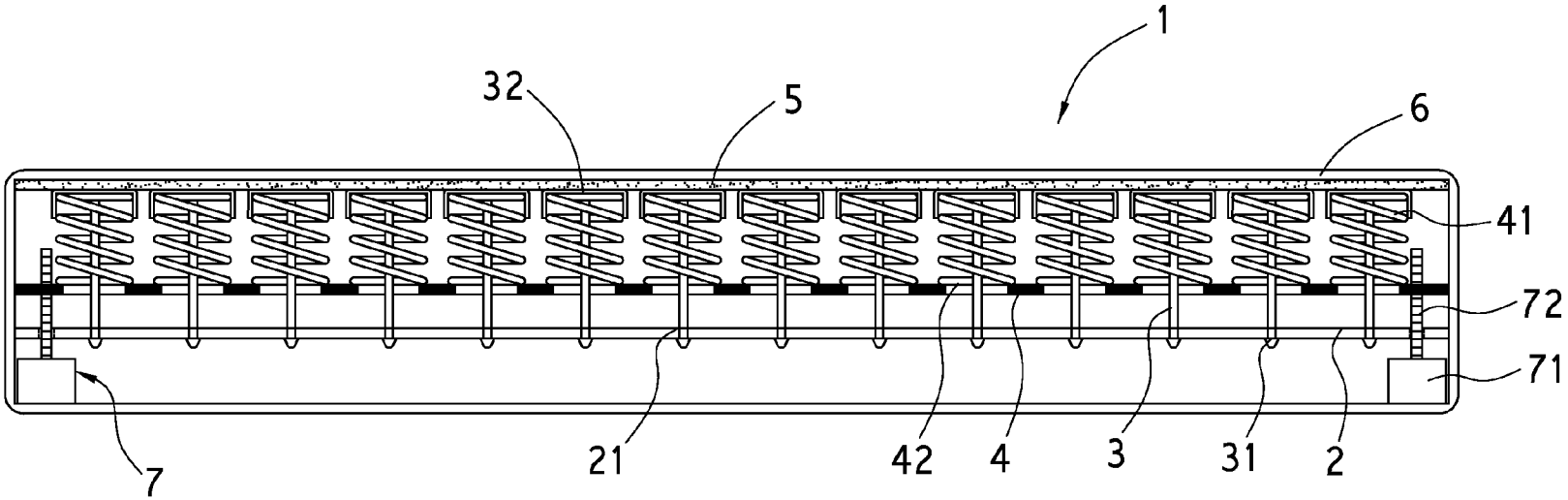
FIG. 3 illustrates a schematic lateral view of the mattress structure of the present invention.
Figure 4:
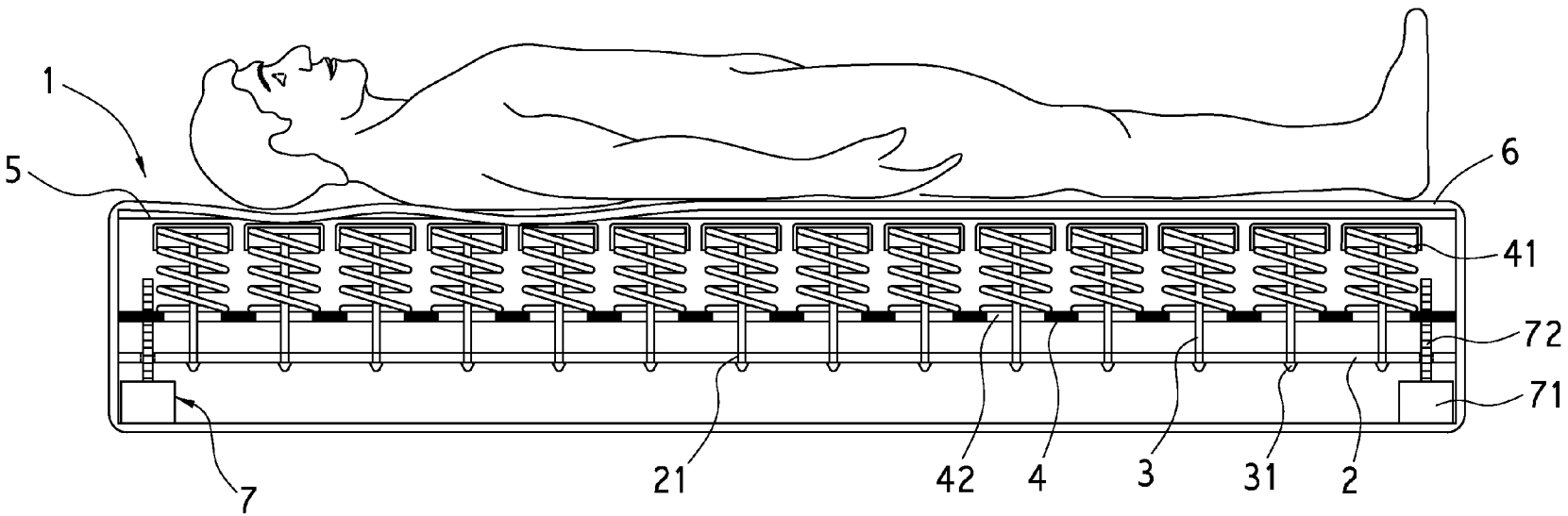
FIG. 4 illustrates a schematic application lateral view of the mattress structure of the present invention.

Following preferred embodiments and figures will be described in detail so as to achieve aforesaid objects.

With references to FIG. 1 to FIG. 4, which illustrate a schematic 3-D exploded view of the mattress structure of the present invention, a schematic 3-D assembled view of the mattress structure of the present invention, a schematic lateral view of the mattress structure of the present invention, and a schematic application lateral view of the mattress structure of the present invention. The mattress structure includes:

a mattress body 1;

a fixing plate 2, which is firmly disposed in the mattress body 1 and has a plurality of fixing holes 21, the fixing plate 2 can be a fixing base or a fixing frame;

a moving plate 4, which is disposed in the mattress body 1 and above the fixing plate 2, a plurality of flexible members 41 are disposed on the surface of the top end of the moving plate 4, the bottom ends of the flexible members 41 are corresponding to the penetrating holes 42, the bottom ends of the flexible members 41 of the moving plate 4 have a plurality of penetrating holes 42;

a plurality of fixing members 3, each of the fixing members 3 has a fastening end 31 and a connecting end 32, the fastening end 31 goes through the penetrating hole 42 and the connecting end 32 shaped as an L-type structure hooks the top end of the flexible member 41, and the fastening end 31 associates with the fixing hole 21 of the fixing plate 2, the fastening end 31 of the fixing member 3 is shaped as a ladder-type structure so as to let the fixing member 3 be fixed in the fixing plate 2 while the fastening end 31 is inserted into the fixing hole 21, further that, the connecting end 32 and the fixing member 3 are integrally made and shaped as an L-type structure;

a flexible layer 5, which is disposed on the top layer of the flexible member 41;

a wrapper 6, is covered around the peripheries of the mattress body 1;

a plurality of lifting devices 7, which is disposed at the bottom of the moving plate 4 or the bottom of the fixing plate 2, for the embodiment, the lifting devices 7 are disposed at the four corners of the moving plate 4 or the four corners of the fixing plate 2, such two locations may not be limited to the scope, and the center of the moving plate 4 is another option, the lifting device 7 has a plurality of motors 71 and a plurality of power transmission shafts 72 connected with the moving plate 4, each of the power transmission shaft 72 is a screw rod, therefore the moving plate 4 is moved up and down through the motors 71 driving the power transmission shafts 72, the connecting end 32 of the fixing member 3 and the fixing member 3 are integrally made, one point to be noted is the connecting end 32 can be made by soft lines and connected with the flexible members 41;

further, the lifting device 7 is not only a motor and can be a gasbag, an air pressure stick or an expandable stick as well;

the lifting device 7 is connected with a remote receiver and a remote emitter (not shown in figure), the remote receiver is electrically connected with the motors 71 and receives the signals from the remote emitter in order to control the motors 71, the remote emitter is able to emit singles at least including activation, going up and lowering down to the remote receiver, hence an operator uses the remote receiver to control the up and down actions of the lifting device 7 by means of the remote emitter transmitting signals to the remote receiver.

While the fixing member 3 is a hard pillar, the fastening end 31 and the fixing hole 21 of the fixing plate 2 are fastened to each other, therefore the fixing member 3 goes down while the flexible member 41 presses downwardly.

More, the connecting end 32 of the fixing member 3 can be directly connected with the top end of the flexible member 41 as well.

Figure 5:
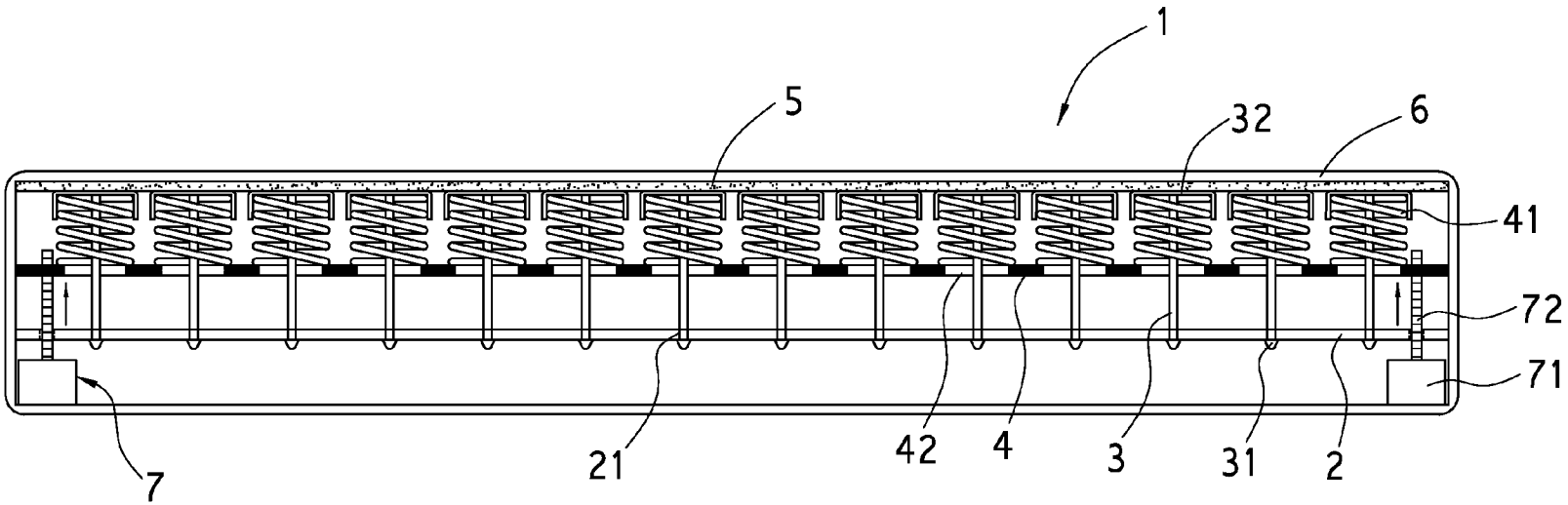
FIG. 5 illustrates a schematic application view of the moving plate of the mattress structure of the present invention.

With reference to FIG. 5, which illustrates a schematic application view of the moving plate of the mattress structure of the present invention. While the user increases the flexible supporting forces of the mattress structure, to start the motors 71 is to drive the power transmission shafts 72 to move the moving plate 4 upwardly. Meanwhile the flexible members 41 are compressed by the moving plate 4 due to the movement of the moving plate 4. Since each of the flexible members 41 is firmly connected with the fixing member 3, then one end of the flexible member 41 is fixed and the other end of the flexible member 41 is compressed. Apparently, the flexible member 41 appears a state of squeeze, and the flexible supporting force is increased. On the contrary, when the user wants to decrease the flexible supporting forces, through the motors 71 of the lifting devices 7 driving the moving plate 4 downwardly is to decrease the squeeze condition of the flexible members 41, so that the flexible supporting forces are decreased.

Figure 6:
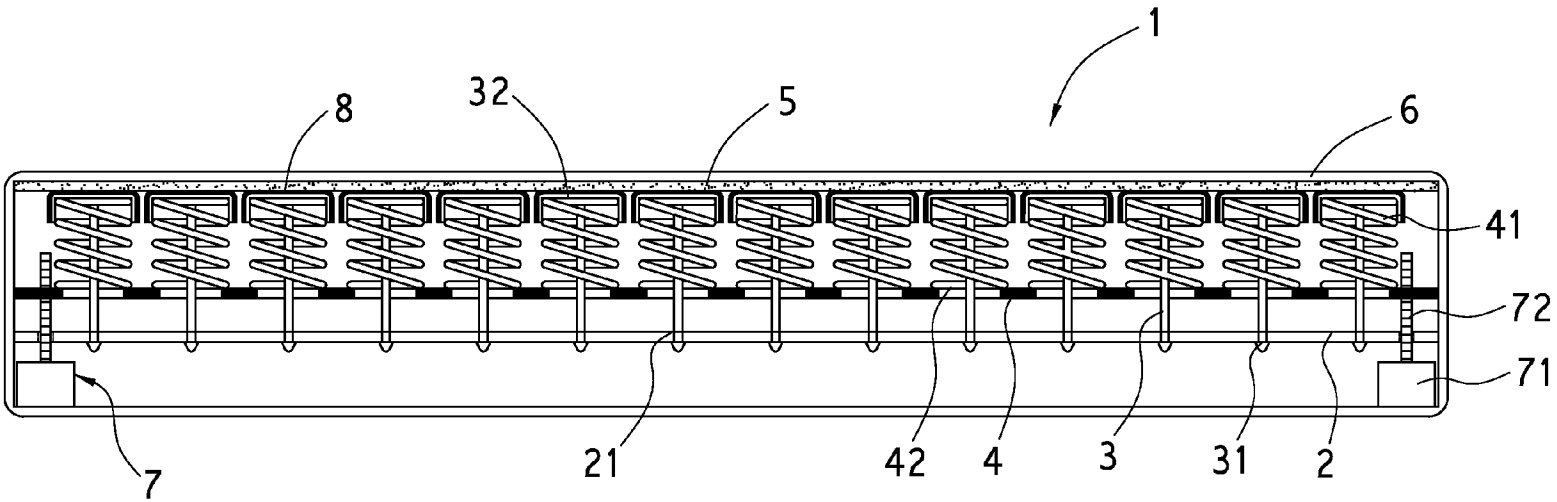
FIG. 6 illustrates another schematic application view of the moving plate of the mattress structure of the present invention.

With reference to FIG. 6, which illustrates another schematic application view of the moving plate of the mattress structure of the present invention. For the embodiment, a cover member 8 is disposed on the top ends of the flexible members 41, that is, the cover member 8 covers around the top ends of the flexible members 41. The cover member 8 may let the flexible members 41 averagely accept the forces while the flexible members 41 are compressed/uncompressed by the moving plate 4 due to the movement of the lifting devices 7 driving the moving plate 4. As a result, not only the life of each of the flexible members 41 is extended, but also the applied flexible supporting forces of the mattress structure are more average.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A mattress structure comprising:

a mattress body;

a fixing plate, being firmly disposed in the mattress body and having a plurality of fixing holes;

a moving plate, being disposed in the mattress body and above the fixing plate, the moving plate having a plurality of penetrating holes;

a plurality of flexible members, being disposed on the surface of the top end of the moving plate, the bottom ends of the flexible members being corresponding to the penetrating holes;

a plurality of fixing members, each of the fixing members having a fastening end and a connecting end, the fastening end going through the penetrating hole and associating with the fixing hole of the fixing plate, the connecting end joining with the top end of the flexible member; and a plurality of lifting devices, being disposed at the bottom of the moving plate, by means of the lifting devices driving the moving plate and the fixing members holding the flexible members, the flexible members being then compressed in order to adjust the flexible supporting forces of the mattress body, wherein the fastening end of the fixing member is shaped as a ladder-type structure so as to let the fixing member be fixed in the fixing plate while the fastening end is inserted into the fixing hole, the connecting end is shaped as an L-type structure in order to hook the top end of the flexible member for connecting the fixing member and the flexible member.

2. The mattress structure according to claim 1, wherein the lifting device is connected with a remote receiver and a remote emitter, an operator uses the remote receiver to control the up and down actions of the lifting device by means of the remote emitter transmitting signals to the remote receiver.

3. The mattress structure according to claim 1, wherein the lifting device has a plurality of motors and a plurality of power transmission shafts connected with the moving plate.

4. The mattress structure according to claim 3, wherein the power transmission shaft is a screw rod.

5. The mattress structure according to claim 1, wherein the top layer of the flexible member is a flexible layer, a wrapper is covered around the peripheries of the mattress body.

6. The mattress structure according to claim 1, wherein the lifting devices are disposed at the four corners of the moving plate.

* * * * *